US009752803B2

(12) United States Patent
Matter, III et al.

(10) Patent No.: US 9,752,803 B2
(45) Date of Patent: Sep. 5, 2017

(54) HEAT PUMP SYSTEM WITH A FLOW DIRECTING SYSTEM

(71) Applicant: Johnson Controls Technology Company, Holland, MI (US)

(72) Inventors: Jerome Anthony Matter, III, Racine, WI (US); Jeffrey Lee Tucker, Wichita, KS (US)

(73) Assignee: Johnson Controls Technology Company, Holland, MI (US)

( * ) Notice: Subject to any disclaimer, the term of this patent is extended or adjusted under 35 U.S.C. 154(b) by 216 days.

(21) Appl. No.: 13/967,604

(22) Filed: Aug. 15, 2013

(65) Prior Publication Data

US 2015/0047384 A1 Feb. 19, 2015

Related U.S. Application Data

(63) Continuation of application No. PCT/US2012/025496, filed on Feb. 16, 2012.

(60) Provisional application No. 61/443,547, filed on Feb. 16, 2011.

(51) Int. Cl.

| | |
|---|---|
| ***F25B 13/00*** | (2006.01) |
| ***G05D 15/00*** | (2006.01) |
| ***G05D 23/00*** | (2006.01) |
| ***F25B 47/02*** | (2006.01) |

(52) U.S. Cl.

CPC ..... *F25B 13/00* (2013.01); *F25B 47/025* (2013.01); *F25B 2313/0315* (2013.01); *F25B 2347/023* (2013.01); *F25B 2700/2106* (2013.01)

(58) Field of Classification Search

CPC ..... F25B 13/00; F25B 30/02; F28D 1/05325

USPC ..... 62/324.6; 165/282, 294, 296; 67/324.6

See application file for complete search history.

(56) References Cited

U.S. PATENT DOCUMENTS

| | | | |
|---|---|---|---|
| 4,483,156 | A | 11/1984 | Oudenhoven |
| 4,932,221 | A | 6/1990 | Shimizu et al. |
| 5,085,058 | A | 2/1992 | Aaron et al. |
| 5,826,649 | A | 10/1998 | Chapp et al. |
| 5,970,729 | A | 10/1999 | Yamamoto et al. |

(Continued)

FOREIGN PATENT DOCUMENTS

| | | |
|---|---|---|
| CN | 101600919 | 12/2009 |
| JP | H0732460 | 6/1995 |

(Continued)

OTHER PUBLICATIONS

International Search Report for PCT application No. PCT/US06/00443 dated Jun. 12, 2006.

(Continued)

*Primary Examiner* — Frantz Jules
*Assistant Examiner* — Steve Tanenbaum
(74) *Attorney, Agent, or Firm* — Fletcher Yoder, P.C.

(57) ABSTRACT

A heat pump system is provided that includes a flow directing system that allows an outdoor heat exchanger to be switchable between a single-pass arrangement and a two-pass arrangement. The heat pump system includes an outdoor heat exchanger, an indoor heat exchanger, and a flow directing system of check valves and piping segments that enable switching of the outdoor heat exchanger between the single-pass and the two-pass arrangement. The outdoor heat exchanger is operable as a two-pass condenser in the cooling mode and as a single-pass evaporator in the heating mode.

18 Claims, 7 Drawing Sheets

(56) References Cited

U.S. PATENT DOCUMENTS

| | | | | |
|---|---|---|---|---|
| 6,694,750 | B1 | 2/2004 | Lifson et al. | |
| 7,044,200 | B2 | 5/2006 | Gupte et al. | |
| 2003/0015463 | A1* | 1/2003 | Viken | F01M 11/0458 210/138 |
| 2005/0132729 | A1 | 6/2005 | Manole | |
| 2008/0023182 | A1 | 1/2008 | Beamer et al. | |
| 2008/0092573 | A1 | 4/2008 | Vaisman et al. | |
| 2008/0093051 | A1* | 4/2008 | Rios | F25B 41/067 165/61 |
| 2008/0296005 | A1 | 12/2008 | Taras et al. | |
| 2010/0031698 | A1 | 2/2010 | Higashiyama | |
| 2010/0115975 | A1 | 5/2010 | Mitra et al. | |
| 2011/0079032 | A1* | 4/2011 | Taras | F24F 3/153 62/113 |

FOREIGN PATENT DOCUMENTS

| | | | | |
|---|---|---|---|---|
| JP | 2002243296 | | 8/2002 | |
| JP | 2002243296 | A * | 8/2002 | |
| JP | 2010216692 | | 9/2010 | |
| JP | 2012077921 | A * | 4/2012 | |
| WO | 2006083426 | | 8/2006 | |
| WO | 2006083484 | | 8/2006 | |
| WO | 2008045039 | | 4/2008 | |
| WO | 2008045040 | | 4/2008 | |
| WO | 2008045086 | | 4/2008 | |
| WO | 2008064238 | | 5/2008 | |
| WO | WO 2012147336 | A1 * | 11/2012 | F25B 30/00 |

OTHER PUBLICATIONS

CN 2nd Office Action for CN Application No. 201280009372.X dated Jun. 19, 2015.

* cited by examiner

HEAT PUMP SYSTEM WITH A FLOW DIRECTING SYSTEM

CROSS REFERENCE TO RELATED APPLICATIONS

This application claims priority from and the benefit of PCT Patent Application No. PCT/US12/25496, entitled "HEAT PUMP SYSTEM WITH A FLOW DIRECTING SYSTEM," filed Feb. 16, 2012, which is herein incorporated by reference in its entirety, and which claims priority to and benefit of U.S. Provisional Application Ser. No. 61/443,547, entitled "HEAT PUMP SYSTEM WITH A FLOW DIRECTING SYSTEM," filed Feb. 16, 2011, which is hereby incorporated by reference.

BACKGROUND

The invention relates generally to the field of heating, ventilating, air conditioning, and refrigeration (HVAC&R) systems, and more particularly to heat pump systems with a flow directing system that allows a heat exchanger to be switchable between a single-pass arrangement and a two-pass arrangement.

A wide range of applications exist for heating, ventilating, air conditioning and refrigeration (HVAC&R) systems. For example, residential, light commercial, commercial and industrial systems are used to control temperatures and air quality in residences and buildings. Very generally, these systems operate by implementing a thermal cycle in which fluids are heated and cooled to provide the desired temperature in a controlled space, typically the inside of a residence or building. Similar systems are used for vehicle cooling, and as well as for general refrigeration.

Controlled fluids within such systems are typically confined with enclosed circuits and include various refrigerants. Refrigerants are specifically formulated to undergo phase changes within the normal operating temperatures and pressures of the systems so that considerable quantities of heat can be exchanged by virtue of the latent heat of vaporization of the circulated refrigerant. In most such systems, for example, the refrigerant is evaporated in one heat exchanger to draw heat from air circulating through the heat exchanger for cooling purposes. Conversely, the refrigerant is then condensed in a different heat exchanger to release heat from the refrigerant and thereby heat an air stream. Depending upon whether the evaporating heat exchanger and condensing heat exchanger are inside of the controlled space or outside of the controlled space, the system will function to heat or cool the air within the space.

In heat pump systems, the direction of refrigerant flow through evaporating and condensing heat exchangers can be reversed to allow for extraction of heat from a controlled space (cooling mode) and for the injection of heat into the space (heating mode). For example, in the cooling mode, vapor phase refrigerant may flow in a first direction from a compressor to an outdoor heat exchanger that condenses the refrigerant. The liquid refrigerant may then flow through an expansion device to an indoor heat exchanger that evaporates the refrigerant to cool the controlled space. Accordingly, in the cooling mode, the outdoor heat exchanger operates as a condenser and the indoor heat exchanger operates as an evaporator. In the heating mode, refrigerant flows through the system in an opposite direction, and the roles of the heat exchangers are reversed. For example, vapor phase refrigerant may flow from the compressor to the indoor heat exchanger, which condenses the refrigerant to heat the controlled space. The refrigerant may then flow through the expansion valve to the outdoor heat exchanger, which evaporates the refrigerant. The refrigerant then flows to the compressor to repeat the cycle through the system. Accordingly, in the heating mode, the outdoor heat exchanger operates as an evaporator and the indoor heat exchanger operates as a condenser.

In typical heat pump systems, the direction of flow within the system is reversed to switch the heat pump system between a cooling mode and a heating mode. Accordingly, the flow of refrigerant through the heat exchangers is reversed, and consequently, the refrigerant flows through a heat exchanger with the same number of passes in both the heating and cooling modes. However, it may be inefficient and/or undesirable to employ the same number of passes for both the heating and cooling modes of operation.

SUMMARY

The present invention relates to a heat pump system that includes a reversing valve configured to circulate a refrigerant through a closed loop in a first direction when the heat pump system is operating in a heating mode and in a second direction opposite of the first direction when the heat pump system is operating in a cooling mode. The heat pump system also includes a compressor configured to compress the refrigerant, an indoor heat exchanger operable as a condenser in the heating mode and as an evaporator in the cooling mode, and an outdoor heat exchanger operable as a two-pass condenser in the cooling mode and as a single-pass evaporator in the heating mode. The outdoor heat exchanger includes a first manifold, a second manifold subdivided by a baffle into a first section and a second section, and a plurality of tubes in fluid communication with the first manifold and the second manifold. The heat pump system also includes a flow directing system and at least one expansion device disposed in the closed loop between the indoor heat exchanger and the outdoor heat exchanger, and configured to reduce pressure of the refrigerant. The flow directing system includes one or more valves and piping segments of the closed loop and is configured to direct the refrigerant into the first section of the second manifold and out of the second section of the second manifold to the expansion device in the cooling mode and to direct the refrigerant into the first manifold and out of the first and second sections of the second manifold to the reversing valve in the heating mode.

The present invention also relates to a heat pump system that includes a reversing valve configured to circulate a refrigerant through a closed loop in a first direction when the heat pump system is operating in a heating mode and in a second direction opposite of the first direction when the heat pump system is operating in a cooling mode. The heat pump system also includes a compressor configured to compress the refrigerant, an indoor heat exchanger operable as a condenser in the heating mode and as an evaporator in the cooling mode, and an outdoor heat exchanger operable as a two-pass condenser in the cooling mode and as a single-pass evaporator in the heating mode. The outdoor heat exchanger includes a first manifold, a second manifold subdivided by a baffle into a first section and a second section, and a plurality of tubes in fluid communication with the first manifold and the second manifold. The heat pump system also includes a flow directing system and at least one expansion device disposed in the closed loop between the indoor heat exchanger and the outdoor heat exchanger, and configured to reduce pressure of the refrigerant. The flow directing system includes one or more valves and piping segments of the closed loop and is configured to direct the refrigerant into the first section of the second manifold and out of the second section of the second manifold to the expansion device in the cooling mode and to direct the refrigerant into the first section and second section of the second manifold and out of the first manifold to the reversing valve in the heating mode.

The present invention also relates to a heat pump system that includes a reversing valve configured to circulate a refrigerant through a closed loop in a first direction when the heat pump system is operating in a heating mode and in a second direction opposite of the first direction when the heat pump system is operating in a cooling mode. The heat pump system also includes an indoor heat exchanger, an outdoor heat exchanger, and a flow directing system. The outdoor heat exchanger includes a first manifold, a second manifold subdivided by a baffle into a first section and a second section, and a plurality of tubes in fluid communication with the first manifold and the second manifold. The flow directing system includes one or more valves and piping segments of the closed loop and is configured to, in the cooling mode, direct the refrigerant to enter the outdoor heat exchanger through the first section of the second manifold and to exit the outdoor heat exchanger through the second section of the second manifold and, in the heating mode, to direct the refrigerant to enter the outdoor heat exchanger through the first manifold and to exit the outdoor heat exchanger through the first and second sections of the second manifold or to direct the refrigerant to enter the outdoor heat exchanger through the first and second sections of the second manifold and to exit the outdoor heat exchanger through the first manifold.

DRAWINGS

DETAILED DESCRIPTION

The present application is directed to heat pump systems that include an outdoor heat exchanger that is switchable between a single-pass arrangement and a two-pass arrangement. In particular, the outdoor heat exchanger is designed to function as a two-pass condenser when the heat pump system is operating in a cooling mode and as a single-pass evaporator when the heat pump system is operating in a heating mode. According to certain embodiments, the operation of the outdoor heat exchanger as a two-pass condenser may promote subcooling of the refrigerant in the cooling mode, which in turn, may improve the operating efficiency of the heat pump system. Further, the operation of the outdoor heat exchanger as a single-pass evaporator may allow the liquid refrigerant entering the evaporator to be distributed to each of the heat exchanger tubes to promote efficient evaporation of the liquid refrigerant within the heat exchanger tubes with a low pressure drop, which can enhance system performance.

A flow directing system of check valves and piping segments enables switching of the outdoor heat exchanger between the single-pass arrangement and the two-pass arrangement. According to certain embodiments, the check valves are disposed in the closed loop external to the outdoor heat exchanger to facilitate maintenance. The outdoor heat exchanger generally includes at least two sets of heat exchange tubes designed to direct refrigerant between two manifolds of the heat exchanger. The piping segments and check valves are designed to direct fluid into one manifold in the cooling mode and into the other manifold in the heating mode. For example, in the cooling mode, refrigerant enters the outdoor heat exchanger through a first manifold, flows through one set of tubes to the second manifold, and returns to the first manifold through a second set of tubes. In the heating mode, refrigerant enters the outdoor heat exchanger through the second manifold and flows through both sets of tubes in parallel to the first manifold.

Figure 1:
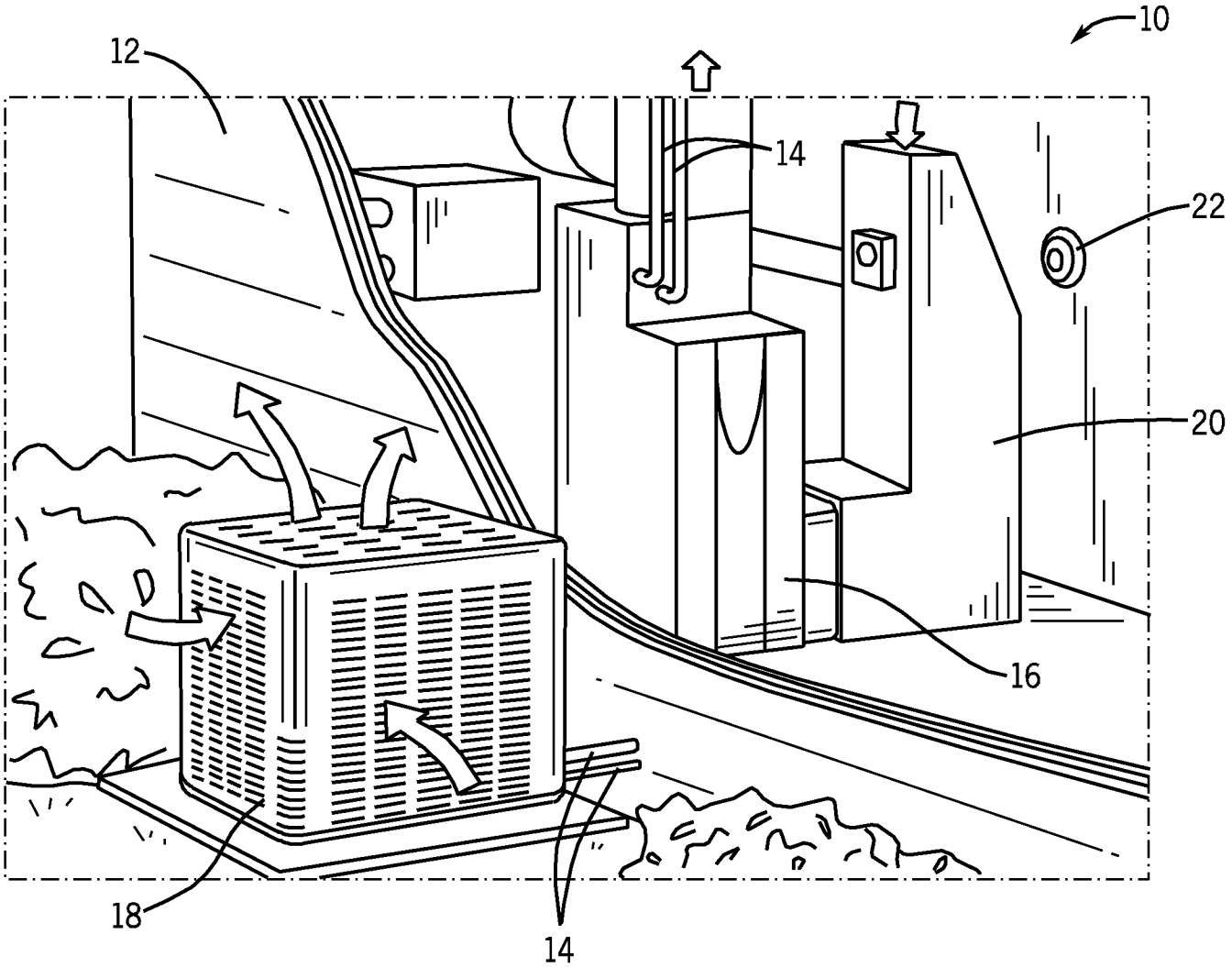
FIG. 1 is an illustration of an embodiment of a residential HVAC&R system that may employ a heat pump system with an outdoor heat exchanger switchable between a two-pass condenser and a single-pass evaporator, in accordance with the present techniques.

FIG. 1 depicts an exemplary application for a heat pump system that employs an outdoor heat exchanger that is switchable between a two-pass arrangement and a single-pass arrangement. Such systems, in general, may be applied in a range of settings, both within the HVAC&R field and outside of that field. In presently contemplated applications, however, heat pump systems may be used in residential, commercial, light industrial, industrial and in any other application for heating and cooling a volume or enclosure, such as a residence, building, structure, and so forth. For example, as shown in FIG. 1, a heat pump system 10 can be employed in a building, such as a residence 12. Heat pump system 10 includes a closed loop 14 that circulates a fluid, such as refrigerant, between an indoor unit 16 and an outdoor unit 18. Indoor unit 16 may be positioned in a utility room, an attic, a basement, and so forth. Outdoor unit 18 is typically situated adjacent to a side of residence 12 and is covered by a shroud to protect the system components and to prevent leaves and other contaminants from entering the unit. Closed loop 14 includes piping that transfers refrigerant between indoor unit 16 and outdoor unit 18, typically transferring primarily liquid refrigerant in one direction and primarily vaporized refrigerant in an opposite direction.

When the system shown in FIG. 1 is operating in a cooling mode, a heat exchanger in outdoor unit 18 functions as a condenser for condensing vaporized refrigerant flowing from indoor unit 16 to outdoor unit 18 within closed loop 14. In these applications, a heat exchanger of indoor unit 16 functions as an evaporator for evaporating liquid refrigerant before returning the refrigerant to outdoor unit 18.

Outdoor unit 18 draws in environmental air through its sides as indicated by the arrows directed to the sides of the unit, forces the air through outdoor unit 18 by means of a fan (not shown), and expels the air as indicated by the arrows above outdoor unit 18. When operating in the cooling mode, the air is heated by the heat exchanger of outdoor unit 18 and exits the top of the unit at a temperature higher than it entered the sides. Air is blown over the heat exchanger of indoor unit 16 and is then circulated through residence 12 by means of ductwork 20, as indicated by the arrows entering and exiting ductwork 20. The overall system operates to maintain a desired temperature as set by a thermostat 22. When the temperature sensed inside residence 12 is higher than the set point on thermostat 22 (plus a small amount), the heat exchanger of outdoor unit 18 will become operative to refrigerate additional air for circulation through residence 12. When the temperature reaches the set point (minus a small amount), heat pump system 10 will stop the refrigeration cycle temporarily.

When the unit in FIG. 1 operates in the heating mode, the roles of the heat exchangers of indoor unit 16 and outdoor unit 18 are reversed. That is, the heat exchanger of outdoor unit 18 will serve as an evaporator to evaporate refrigerant and thereby cool air entering outdoor unit 18 as the air passes over outdoor unit 18. The heat exchanger within indoor unit 16 will receive a stream of air blown over it and will heat the air by condensing the refrigerant.

Figure 2:
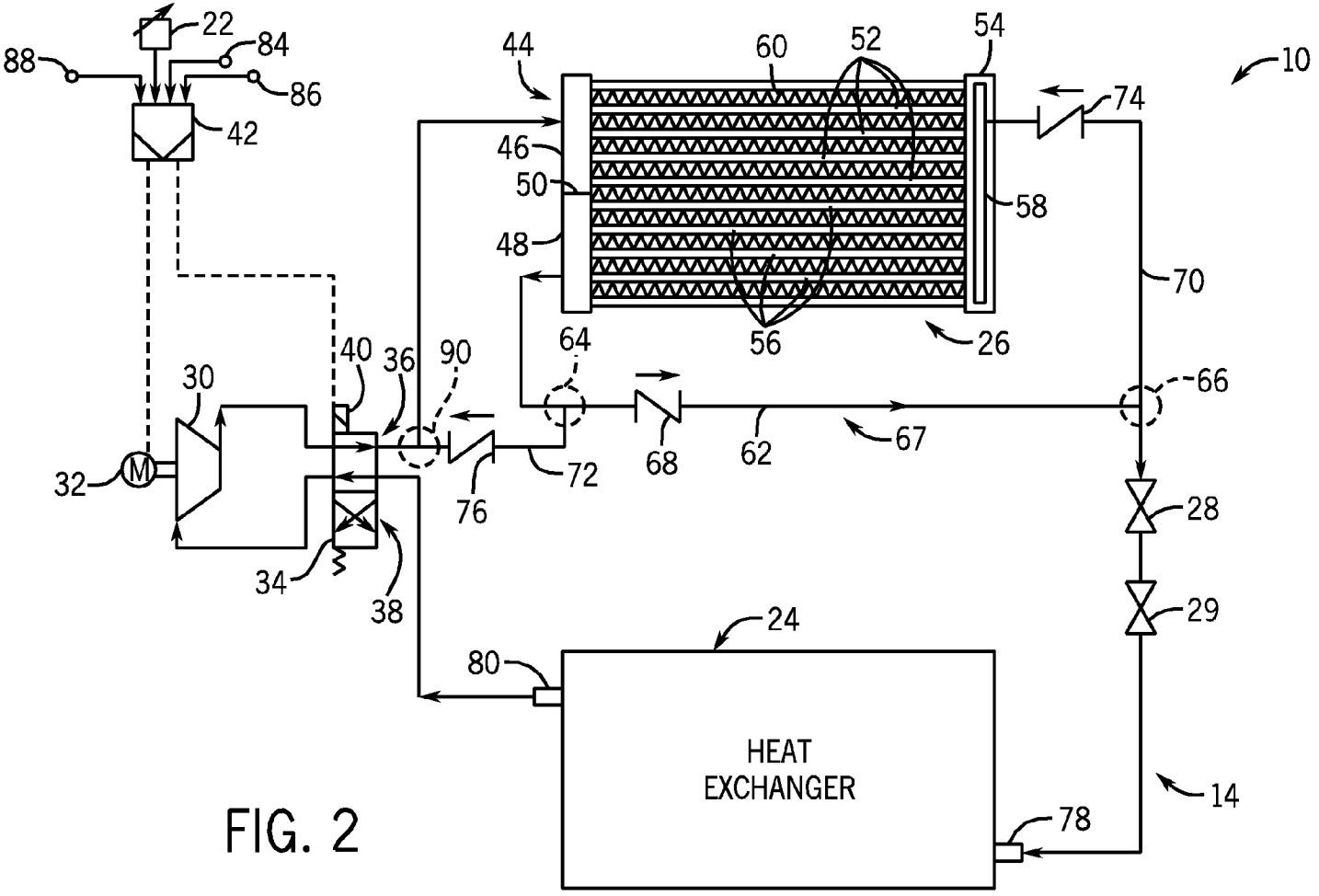
FIG. 2 is a diagrammatical overview showing the cooling mode of the heat pump system of FIG. 1, in accordance with the present techniques.
Figure 3:
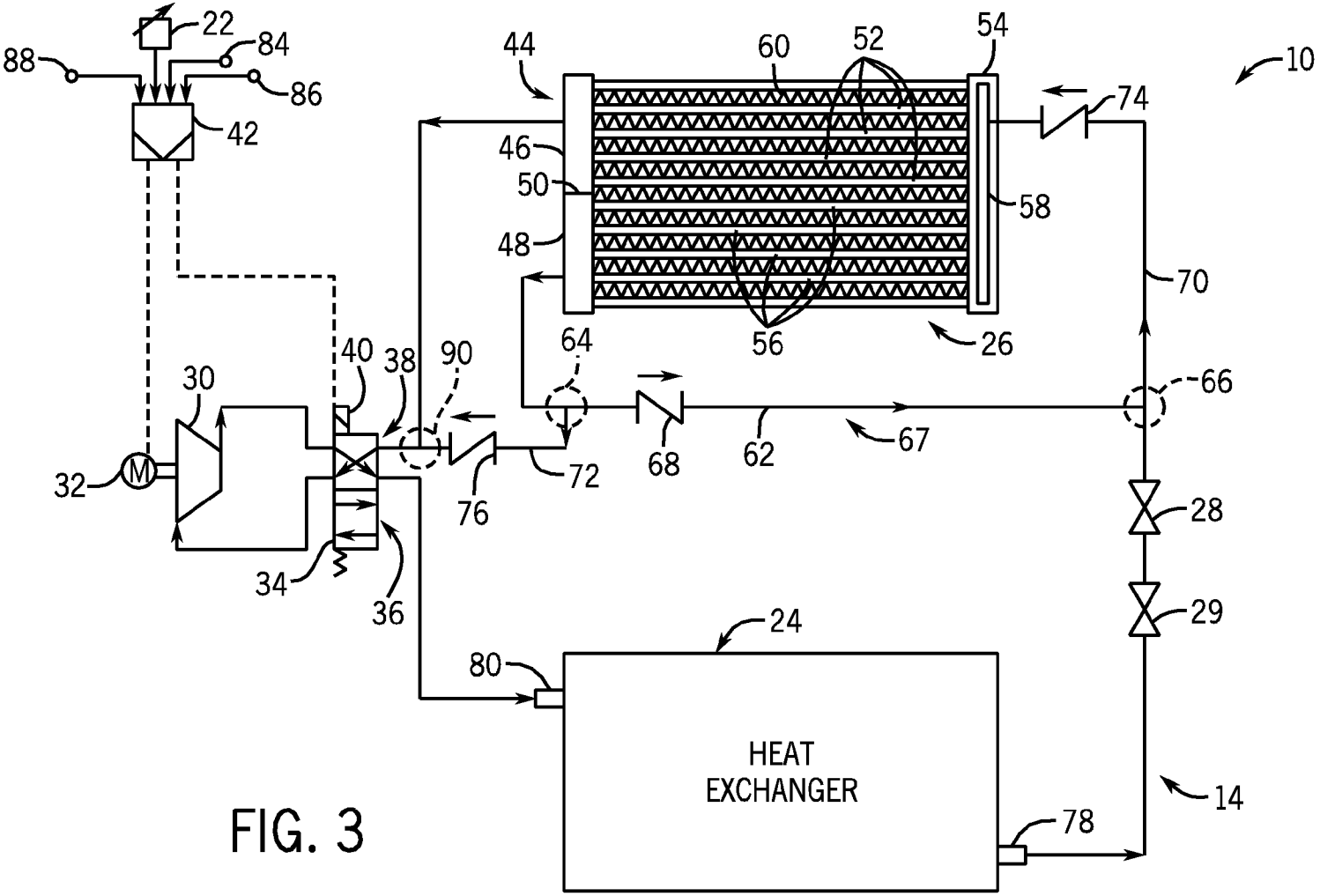
FIG. 3 is a diagrammatical overview showing the heating mode of the heat pump system of FIG. 2, in accordance with the present techniques.

FIGS. 2 and 3 depict the flow of refrigerant through heat pump system 10, with arrows used to depict the direction of refrigerant flow. In particular, FIG. 2 depicts heat pump system 10 operating in a cooling mode where the heat exchanger in the outdoor unit functions as a condenser and the heat exchanger in the indoor unit functions as an evaporator. FIG. 3 depicts the heat pump system operating in the heating mode where the heat exchanger in the indoor unit functions as a condenser and the heat exchanger in the outdoor unit functions as an evaporator. As can be seen by comparing FIGS. 2 and 3, the flow of refrigerant through heat pump system 10 is reversed when switching between the cooling and heating modes.

Refrigerant flows through heat pump system 10 within closed loop 14. Because heat pump system 10 can operate in both a cooling mode and a heating mode, refrigerant can flow through closed loop 14 in one direction for the cooling mode as shown in FIG. 2, and in the opposite direction for the heating mode, as shown in FIG. 3. The refrigerant may be any fluid that absorbs and extracts heat. For example, the refrigerant may be hydrofluorocarbon (HFC) based R-410A, R-407, or R-134a, or it may be carbon dioxide (R-744) or ammonia (R-717).

Heat pump system 10 also includes an indoor heat exchanger 24, an outdoor heat exchanger 26, expansion devices 28 and 29, and a compressor 30. Each heat exchanger 24 and 26 may function as an evaporator and a condenser, depending on the operational mode of the heat pump system. For example, when heat pump system 10 is operating in the cooling mode, outdoor heat exchanger 26 functions as a condenser, releasing heat to the outside air, while indoor heat exchanger 24 functions as an evaporator, absorbing heat from the inside air. When heat pump system 10 is operating in the heating mode, outdoor heat exchanger 26 functions as an evaporator, absorbing heat from the outside air, while indoor heat exchanger 24 functions as a condenser, releasing heat to the inside air.

FIG. 2 depicts heat pump system 10 operating in the cooling mode. Accordingly, outdoor heat exchanger 26 operates as a two-pass condenser and indoor heat exchanger 24 functions as an evaporator. Heat pump system 10 cools an environment by circulating refrigerant within closed loop 14 through indoor heat exchanger 24, compressor 30, outdoor heat exchanger 26, and expansion devices 28 and 29.

Within closed loop 14, refrigerant flows to compressor 30 as primarily a low pressure and temperature vapor. Compressor 30 reduces the volume available for the refrigerant vapor, consequently, increasing the pressure and temperature of the vapor refrigerant. Compressor 30 may be any suitable compressor such as a screw compressor, reciprocating compressor, rotary compressor, swing link compressor, scroll compressor, or turbine compressor. Compressor 30 is driven by a motor 32 that receives power from a variable speed drive (VSD) or a direct AC or DC power source. Motor 32 may receive fixed line voltage and frequency from an AC power source, a variable voltage, or frequency drive. Further, motor 32 may be a switched reluctance (SR) motor, an induction motor, an electronically commutated permanent magnet motor (ECM), or any other suitable motor type. The refrigerant exits compressor 30 as primarily a high temperature and pressure vapor.

The refrigerant flows through reversing valve 34 to outdoor heat exchanger 26. Reversing valve 34 is positioned in refrigeration circuit 14 between the outdoor and indoor heat exchangers 26 and 24 to control the direction of refrigerant flow through the closed loop 14 and to thereby switch the heat pump system 10 between the cooling mode and the heating mode. For example, reversing valve 34 includes a cooling position 36 that directs refrigerant through closed loop 14 in a first direction, as shown in FIG. 2, when the heat pump system 10 is operating in the cooling mode. Reversing valve 36 also includes a heating position 38 that directs refrigerant through closed loop 14 in an opposite direction, as shown in FIG. 3, when the heat pump system 10 is operating in the heating mode. According to certain embodiments, a solenoid 40 can be actuated by signals from control circuitry 42 to switch reversing valve 34 between the cooling and heating position 36 and 38.

After flowing through reversing valve 34, the refrigerant enters outdoor heat exchanger 26 (operating as a condenser) through a manifold 44. Manifold 44 is divided into sections 46 and 48 by a baffle 50. According to certain embodiments, baffle 50 may be inserted, affixed, and/or interference fit within manifold 44 to impede the flow of refrigerant between sections 46 and 48 of manifold 44. Further, in other embodiments, baffle 50 may be an integral part of manifold 44 and/or may be a double baffle.

Baffle 50 separates refrigerant entering outdoor heat exchanger 26 from refrigerant exiting outdoor heat exchanger 26, creating two-passes for refrigerant flowing through the heat exchanger in the cooling mode. In particular, baffle 50 directs refrigerant entering manifold 44 though section 46 into tubes 52. The refrigerant then flows through tubes 52 into manifold 54. As the refrigerant flows through tubes 52, the refrigerant may be cooled by air that is pushed or pulled across tubes 52, for example, by a fan. According to certain embodiments, some, or all, of the refrigerant may be condensed as the refrigerant flows through tubes 52 and transfers heat to the environment. From manifold 54, the refrigerant flows through tubes 56 to section 48 of manifold 44. As the refrigerant flows through tubes 56, the refrigerant may be cooled by air that is drawn across tubes 56, for example, by a fan. According to certain embodiments, the refrigerant may be subcooled as the refrigerant flows through tubes 56.

In summary, in the cooling mode, the refrigerant flows through outdoor heat exchanger 26 in two passes. In the first pass, the refrigerant is cooled as the refrigerant flows through tubes 52 from section 46 of manifold 44 to manifold 54. The refrigerant then flows through tubes 56 from manifold 54 to the other section 48 of manifold 44 in a second pass. Accordingly, in the cooling mode, the refrigerant flows through each set of tubes 52 and 56 in series. According to certain embodiments, manifold 54 may include a distributor device 58, which may be used to distribute the flow of refrigerant in the heating mode, as described below with respect to FIG. 3. However, in other embodiments, distributor device 58 may be omitted or refrigerant distribution can be accomplished with a different device.

Fins 60 are located between tubes 52 and 56 to promote heat transfer between tubes 52 and 56 and the environment. According to certain embodiments, the fins are constructed of aluminum, brazed or otherwise jointed to the tubes, and disposed generally perpendicular to the flow of refrigerant. However, in other embodiments, the fins may be made of other materials that facilitate heat transfer and may extend parallel or at varying angles with respect to the flow of refrigerant. The fins may be corrugated fins or plate fins and, in certain embodiments, may include features such as louvers, collars, and the like. Further, in certain embodiments, the fins may be omitted.

As shown in FIG. 2, heat exchanger 26 has generally horizontal tubes 52 and 56 that extend between generally vertical manifolds 44 and 54. However, in other embodiments, the heat exchanger may be rotated approximately 90 degrees so that the tubes extend vertically between a top and bottom manifold. Further, the heat exchanger may be provided in a single plane or slab, or may include bends, corners, contours, and so forth. The manifolds and tubes may be constructed of aluminum or any other material that promotes good heat transfer. According to certain embodiments, the tubes may be multichannel tubes that each contain two or more generally parallel flow paths extending along the length of the tubes. However, in other embodiments, the tubes may be generally round tubes that each contain a single flow path.

The refrigerant exits outdoor heat exchanger 26 through section 48 of manifold 44 and flows through a piping segment 62 of closed loop 14 that extends between connection points 64 and 66. Piping segment 62 is part of a flow directing system 67 that is included within closed loop 14. Flow directing system 67 includes piping segment 62, as well as a check valve 68 disposed in piping segment 62, piping segments 70 and 72, and check valves 74 and 76 that are disposed in piping segments 70 and 72, respectively. Flow directing system 67 is designed to direct the flow of refrigerant through outdoor heat exchanger 26 in a two-pass arrangement in the cooling mode and in a single-pass arrangement in the heating mode. For example, in the cooling mode, flow directing system 67 directs refrigerant into outdoor heat exchanger 26 though section 46 of manifold 44 and out of outdoor heat exchanger 26 through section 48 of manifold 44. Accordingly, refrigerant enters and exits outdoor heat exchanger 26 through different sections of the same manifold, allowing refrigerant to flow through the heat exchanger in a two-pass arrangement. The refrigerant exiting outdoor heat exchanger 26 then flows through piping segment 62 and check valve 68 to expansion devices 28 and 29.

Check valves 68, 74, and 76 are designed to control the direction of refrigerant flow through closed loop 14. Check valves 68, 74, and 76 may be ball check valves, diaphragm check valves, swing check valves, or other types of check valve suitable for unidirectional flow. In the cooling mode, check valves 68, 74, and 76 direct flow from section 48 of manifold 44 through piping segment 62 to expansion devices 28 and 29. For example, check valve 68 allows flow from manifold 44 through piping segment 62 while check valves 74 and 76 inhibit the flow of refrigerant from piping segment 62 through piping segments 70 and 74, respectively, thereby directing the refrigerant to expansion devices 28 and 29. Accordingly, in the cooling mode, refrigerant flows through piping segment 62 of closed loop 14 and bypasses segments 70 and 72 of closed loop 14.

In the heating mode, as discussed further below with respect to FIG. 3, check valves 68, 74, and 76 direct flow from expansion devices 28 and 29 through piping segment 70 into manifold 54 of outdoor heat exchanger 26. The check valves 68, 74, and 76 also direct flow from section 48 of manifold 44 through piping segment 72 to reversing valve 34. Accordingly, in the heating mode, refrigerant flows through piping segments 70 and 72 and bypasses piping segment 62.

In the cooling mode, refrigerant flows through piping segment 62 to expansion devices 28 and 29. In the cooling mode, the refrigerant is expanded in expansion device 28 to become primarily a low pressure and low temperature two-phase refrigerant, while expansion device 29 is generally inactive. As shown in FIGS. 2 and 3, heat pump system 10 includes two unidirectional expansion devices 28 and 29, with one expansion device 28 being employed to expand the refrigerant in the cooling mode and the other expansion device 29 being employed to expand the refrigerant in the heating mode. However, in other embodiments, a single bi-directional expansion device may be employed. According to certain embodiments, expansion devices 28 and 29 are thermal expansion valves (TXV); however, in other embodiments, expansion devices 28 and 29 may be orifices, capillary tubes, or any combination of such devices. The refrigerant exits expansion devices 28 and 29 as a two-phase refrigerant.

From expansion devices 28 and 29, the refrigerant flows to indoor heat exchanger 24 (operating as an evaporator). Refrigerant enters indoor heat exchanger 24 through a connection 78 and then flows through indoor heat exchanger 24 to exit through a connection 80. As the refrigerant flows through indoor heat exchanger 24, the refrigerant may be heated to evaporate the refrigerant. For example, the refrigerant may be heated by a fluid, such as air or water, that is directed over the tubes. Indoor heat exchanger 24 may be any suitable type of heat exchanger, such as a fin and tube heat exchanger, a shell and tube heat exchanger, a plate heat exchanger, a multichannel heat exchanger, or a chiller, among others.

The refrigerant exits indoor heat exchanger 24 through connection 80 and flows through reversing valve 34 to compressor 30 as primarily a low pressure and low temperature vapor. Within compressor 30, the refrigerant is compressed to primarily a high temperature and high pressure vapor that is ready to enter outdoor heat exchanger 26 and begin the refrigeration cycle again.

The operation of heat pump system 10 can be governed by control circuitry 42, which receives inputs from sensors 84, 86, and 88 and thermostat 22. For example, control circuitry 42 may use information received from thermostat 22 to switch heat pump system 10 between the heating mode and the cooling mode. For example, if the thermostat 22 is set to a cooling mode, control circuitry 42 will send a signal to solenoid 40 to place reversing valve 34 in cooling position 36, as shown in FIG. 2. In another example, if the thermostat 22 is set to a heating mode, control circuitry 42 will send a signal to solenoid 40 to place reversing valve 34 in heating position 38, as shown in FIG. 3. Control circuitry 42 may execute hardware or software control algorithms to regulate heat pump system 10. According to exemplary embodiments, control circuitry 42 may include an analog to digital (A/D) converter, a microprocessor, a non-volatile memory, and an interface board.

Sensors 84, 86, and 88 also can provide inputs to control circuitry 42. For example, sensor 84 detects the ambient air temperature and provides the temperature to control circuitry 42. Control circuitry 42 then compares the temperature received from sensor 84 to the temperature set point received from the thermostat 22. If the temperature is above the temperature set point in the cooling mode, or below the temperature set point in the heating mode, control circuitry 42 may turn on compressor motor 32, as well as fans for heat exchangers 24 and 26, to run heat pump system 10.

Input from sensors 86 and 88 may be employed to initiate a defrost cycle when the heat pump system 10 is operating in the heating mode. For example, when the outdoor temperature approaches freezing, moisture in the outside air that is directed over outdoor heat exchanger 26 may condense and freeze on the coil. Sensor 86 measures the outside air temperature, and sensor 88 measures the temperature of outdoor heat exchanger tubes 52 and/or 56. According to certain embodiments, if either sensor 86 or 88 provides a temperature below freezing to control circuitry 42, heat pump system 10 may be placed in a defrost mode where solenoid 40 is actuated to place reversing valve 34 in the cooling position 36 and the fan for the outdoor heat exchanger 26 is turned off. Heat pump system 10 may operate in the cooling mode until the increased temperature and pressure refrigerant flowing through tubes 52 and 56 defrosts the tubes. Once sensor 88 detects that the tubes have defrosted, control circuitry 42 returns the reversing valve 34 to the heating position 38. As may be appreciated, the defrost cycle can be set to occur at many different time and temperature conditions. Further, other devices may be included in heat pump system 10, such as additional pressure and/or temperature transducers or switches that sense temperatures and pressures of the refrigerant, the heat exchangers, the inlet and outlet air, and so forth.

FIG. 3 depicts heat pump system 10 operating in the heating mode where indoor heat exchanger 24 functions as a condenser and outdoor heat exchanger 26 functions as a single-pass evaporator. As can be seen by comparing FIGS. 2 and 3, in the heating mode, reversing valve 34 is in the heating position 38 and the flow of refrigerant through closed loop 14 is reversed. Further, the flow directing system 67 allows refrigerant to flow through outdoor heat exchanger 26 in a single-pass arrangement.

As in the cooling mode, compressor 30 compresses vapor refrigerant to a primarily high temperature and high pressure vapor. From compressor 30, the refrigerant flows through reversing valve 34 to indoor heat exchanger 24, which operates as a condenser. The refrigerant enters indoor heat exchanger 24 through connection 80 and then flows heat exchanger 24 to exit through connection 78. Accordingly, in the heating mode, the refrigerant may flow through heat exchanger 24 in the opposite direction from the cooling mode. For example, in the heating mode, connection 80 functions as an inlet, while in the cooling mode, connection 78 functions as the inlet. As the refrigerant flows through indoor heat exchanger 24, the refrigerant may be cooled by fluid, such as water or air, that is drawn across tubes of the heat exchanger to condense the refrigerant.

From heat exchanger 24, the refrigerant then flows through expansion devices 28 and 29. In the heating mode, the refrigerant is expanded in expansion device 29 to become primarily a low pressure and low temperature two-phase refrigerant, while expansion device 28 is generally inactive. However, as noted above with respect to FIG. 2, in other embodiments, a single bi-directional expansion device may be employed rather than two unidirectional expansion devices. From expansion devices 28 and 29, the refrigerant flows through connection point 66, piping segment 70, and check valve 74 to manifold 54 of outdoor heat exchanger 26. Check valve 68 inhibits the flow of refrigerant through piping segment 62, thereby directing the refrigerant through piping segment 70 to manifold 54. Accordingly, in the heating mode, the refrigerant enters outdoor heat exchanger 26 through the opposite manifold that is used in the cooling mode. For example, in the heating mode, the refrigerant enters outdoor heat exchanger 26 through manifold 54, while in the cooling mode, the refrigerant enters outdoor heat exchanger 26 through manifold 44.

Within manifold 54, the refrigerant flows through distributor device 58, which distributes the liquid refrigerant along the length of the manifold. According to certain embodiments, distributor device 58 may be a circular tube or pipe concentrically disposed inside manifold 54. However, in other embodiments, distributor device 58 may have a rectangular, trapezoidal, elliptical, or triangular cross-section, among others, and/or may be disposed off-center within manifold 54. Distributor device 58 may include a series of apertures disposed along the length of the distributor device to meter refrigerant flowing through the interior of the distributor device into the manifold. According to certain embodiments, distributor device 58 may include a series of apertures, with each aperture corresponding to one of the tubes 52 or 56. However, in other embodiments, the number and/or alignment of the apertures may vary. Further, in certain embodiments, distributor device 58 may be omitted and refrigerant may be supplied directly into manifold 54. Moreover, in other embodiments, a different type of distributor may be used.

From manifold 54, the refrigerant flows through both sets of tubes 52 and 56 to manifold 44. In particular, the refrigerant flows through tubes 52 to section 46 of manifold 44 and through tubes 56 to section 48 of manifold 44. Accordingly, in the heating mode, refrigerant flows through outdoor heat exchanger 26 in a single-pass arrangement where refrigerant flows through each set of tubes 52 and 56 in parallel. As the refrigerant flows through tubes 52 and 56, the refrigerant is heated by air that is drawn across tubes 52 and 56. According to certain embodiments, some, or all, of the refrigerant is evaporated as the refrigerant flows through tubes 52 and 56 and absorbs heat from the environment.

The refrigerant from each section 46 and 48 of manifold 44 exits manifold 44 through separate outlets and is directed to reversing valve 34. For example, the refrigerant from section 46 flows through connection point 90 and into reversing valve 34. The refrigerant from section 48 flows through connection point 64, through piping segment 72, through check valve 76, and through connection point 90 into reversing valve 34. Accordingly, piping segment 72 allows refrigerant from section 48 of manifold 44 to be recombined with the refrigerant from section 46 of manifold 44 and directed into reversing valve 34.

In summary, in the heating mode, flow directing system 67 directs refrigerant through outdoor heat exchanger 26 in a single-pass. Refrigerant enters outdoor heat exchanger 26 through manifold 54, flows through tubes 52 and 56, and exits heat exchanger 26 through manifold 44. Piping segment 70 directs refrigerant into manifold 54 of heat exchanger 26 and piping segment 72 allows refrigerant exiting section 48 of manifold 44 to be combined with the refrigerant exiting section 46 of manifold 44. Accordingly, in the heating mode, refrigerant flows through piping segments 70 and 72 and bypasses segments 67.

As shown, the refrigerant from the different sections 46 and 48 of manifold 44 is rejoined upstream of reversing valve 34 at connection point 90. However, in other embodiments, the refrigerant from the different sections 46 and 48 may be rejoined within the reversing valve. From reversing valve 34, the refrigerant flows through compressor 30 where the refrigerant is compressed to primarily a high temperature and high pressure vapor. The refrigerant is then directed to the indoor heat exchanger 24 to begin the refrigeration cycle again.

Figure 4:
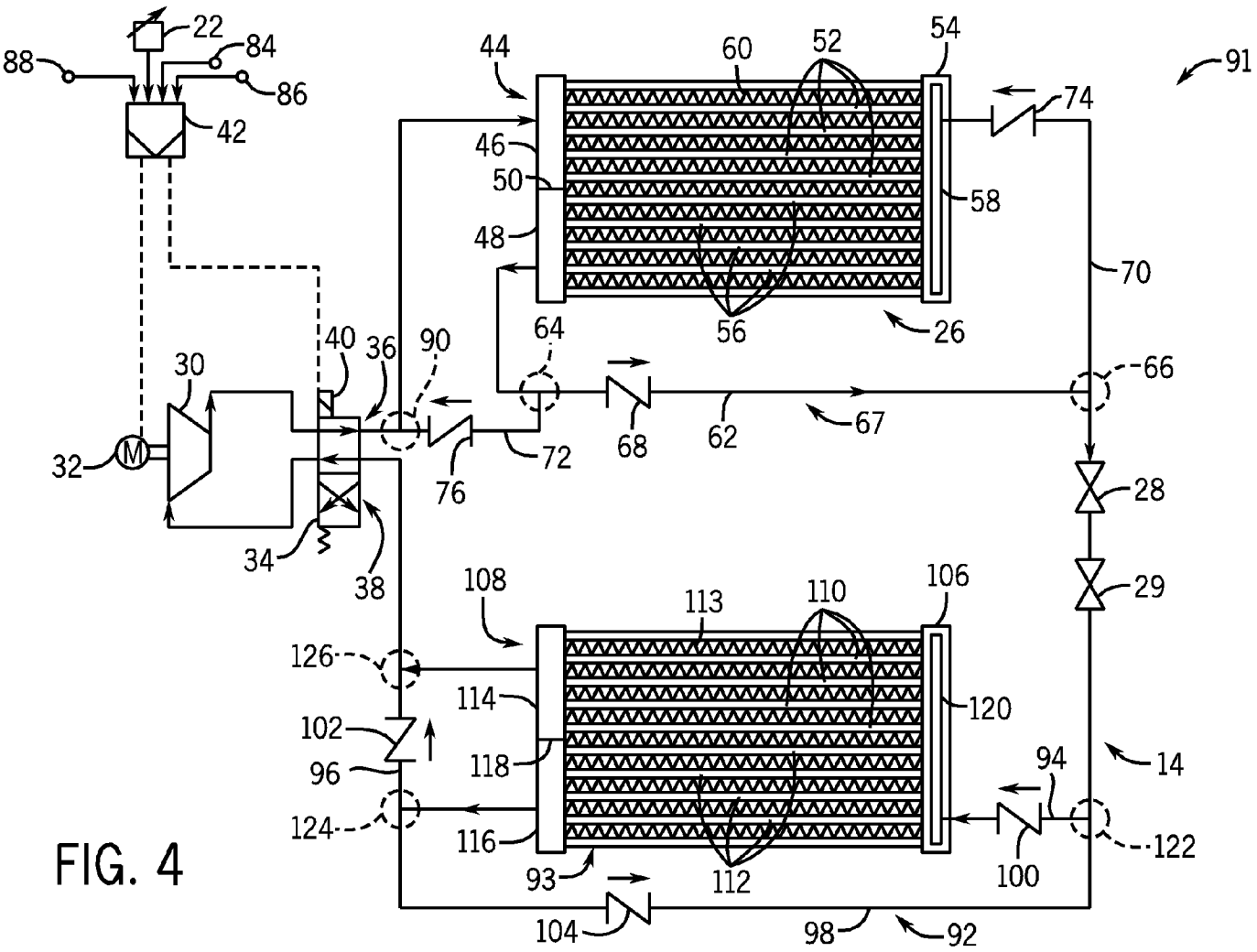
FIG. 4 is a diagrammatical overview showing the cooling mode of another embodiment of a heat pump system with outdoor and indoor heat exchangers switchable between two-pass condensers and single-pass evaporator, in accordance with the present techniques.
Figure 5:
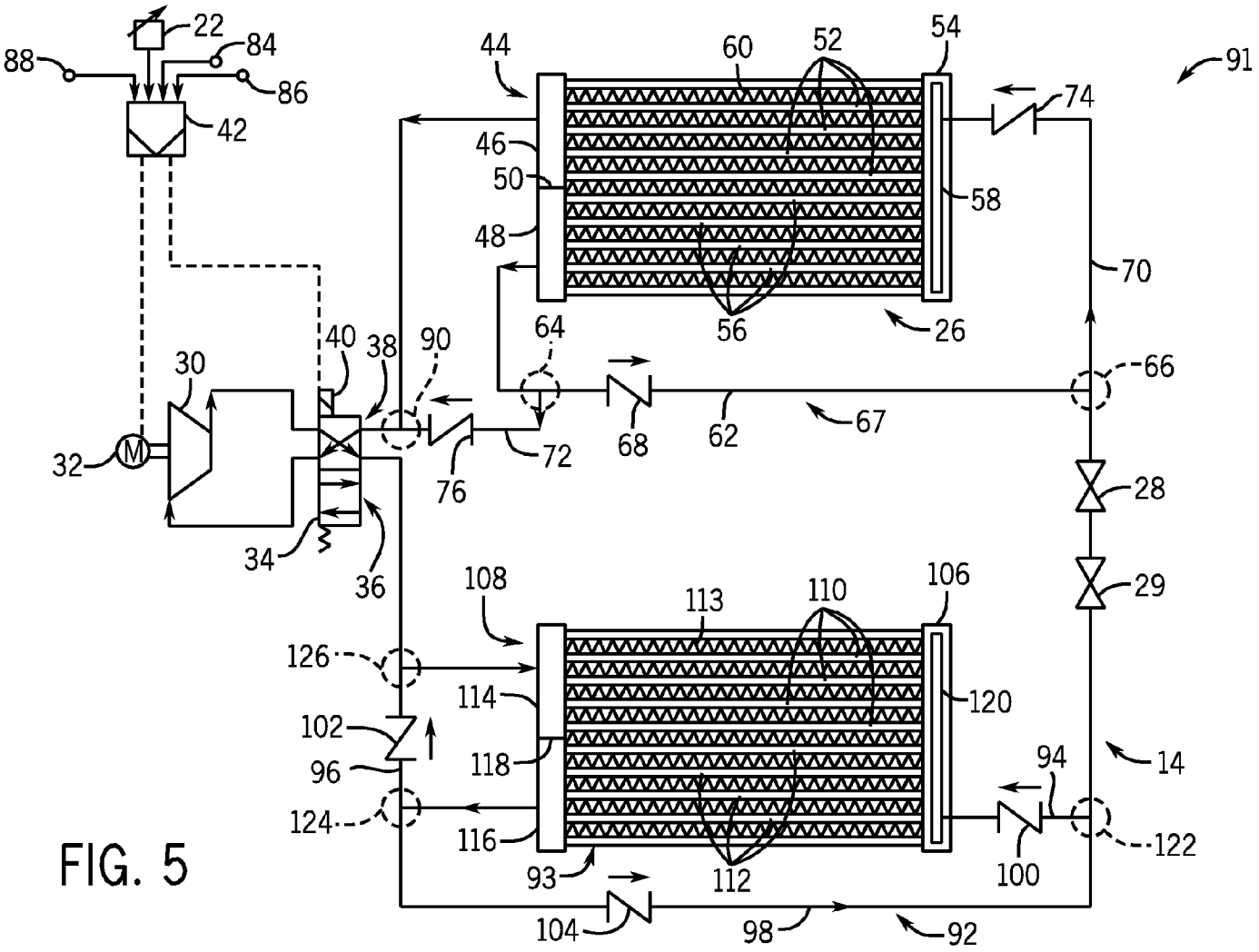
FIG. 5 is a diagrammatical overview showing the heating mode of the heat pump system of FIG. 4, in accordance with the present techniques.

FIGS. 4 and 5 depict another embodiment of a heat pump system 91. Similar to heat pump system 10 (FIGS. 2 and 3), heat pump system 91 includes flow directing system 67, which allows outdoor heat exchanger 26 to operate as a two-pass condenser in the cooling mode and as a single-pass evaporator in the heating mode. Further, heat pump system 91 includes a flow directing system 92 that allows an indoor heat exchanger 93 to switch between a two-pass and a single-pass arrangement. In particular, flow directing system 92 includes piping segments 94, 96, and 98 and check valves 100, 102, and 104 that allow indoor heat exchanger 93 to function as a single-pass evaporator when operating in the cooling mode shown in FIG. 4 and as a two-pass condenser when operating in the heating mode shown in FIG. 5. Check valves 100, 102, and 104 are designed to control the direction of refrigerant flow through closed loop 14. Check valves 100, 102, and 104 may be ball check valves, diaphragm check valves, swing check valves, or other types of check valve suitable for unidirectional flow.

Indoor heat exchanger 93 includes manifolds 106 and 108 that are connected by tubes 110 and 112. The manifolds and tubes may be constructed of aluminum or any other material that promotes good heat transfer. According to certain embodiments, the tubes may be multichannel tubes that each contain two or more generally parallel flow paths extending along the length of the tubes. However, in other embodiments, the tubes may be generally round tubes that each contain a single flow path. Fins 113 are located between tubes 110 and 112 to promote heat transfer between tubes 110 and 112 and the environment. According to certain embodiments, the fins are constructed of aluminum, brazed or otherwise jointed to the tubes, and disposed generally perpendicular to the flow of refrigerant. However, in other embodiments, the fins may be made of other materials that facilitate heat transfer and may extend parallel or at varying angles with respect to the flow of refrigerant. The fins may be corrugated fins or plate fins and, in certain embodiments, may include features such as louvers, collars, and the like. Further, in certain embodiments, the fins may be omitted.

Manifold 108 is divided into sections 114 and 116 by a baffle 118. According to certain embodiments, baffle 118 may be inserted, affixed, and/or interference fit within manifold 108 to impede the flow of refrigerant between sections 114 and 116 of manifold 108. Further, in other embodiments, baffle 118 may be an integral part of manifold 108 and/or may be a double baffle. In the heating mode, discussed below with respect to FIG. 5, baffle 118 separates refrigerant entering indoor heat exchanger 93 from refrigerant exiting indoor heat exchanger 93, creating two-passes for refrigerant flowing through the heat exchanger in the heating mode.

According to certain embodiments, manifold 106 may include a distributor device 120, which may be used to distribute the flow of refrigerant in the cooling mode, as described below with respect to FIG. 4. According to certain embodiments, distributor device 120 may be a circular tube or pipe concentrically disposed inside manifold 106. However, in other embodiments, distributor device 120 may have a rectangular, trapezoidal, elliptical, or triangular cross-section, among others, and/or may be disposed off-center within manifold 106. Distributor device 120 may include a series of apertures disposed along the length of the distributor device to meter refrigerant flowing through the interior of the distributor device into the manifold. According to certain embodiments, distributor device 120 may include a series of apertures, with each aperture corresponding to one of the tubes 110 or 112. However, in other embodiments, the number and/or alignment of the apertures may vary. Further, in certain embodiments, distributor device 120 may be omitted and refrigerant may be supplied directly into manifold 106. Moreover, in other embodiments, a different type of distributor may be used.

FIG. 4 depicts heat pump system 91 operating in the cooling mode where outdoor heat exchanger 26 functions as a two-pass condenser and indoor heat exchanger 93 functions as a single-pass evaporator. Refrigerant is compressed in compressor 30 and flows through reversing valve 34, connection point 90, outdoor heat exchanger 26, piping segment 62, check valve 68, connection point 60, and expansion devices 28 and 29, as described previously in relation to FIG. 2. The refrigerant then flows through connection point 122, which connects piping segments 94 and 98. In the cooling mode, check valves 100 and 104 direct flow from expansion devices 28 and 29 through piping segment 94 into manifold 106 of outdoor heat exchanger 93. For example, check valve 100 allows flow from connection point 122 through piping segment 94, while check valves 104 inhibits the flow of refrigerant from connection point 122 through piping segment 98. Accordingly, in the cooling mode, refrigerant flows through piping segment 94 of closed loop 14 and bypasses segment 98 of closed loop 14.

The refrigerant from piping segment 94 flows into distributor device 120, which distributes the liquid refrigerant along the length of the manifold. From manifold 106, the refrigerant flows through both sets of tubes 110 and 112 to sections 114 and 116 of manifold 108, respectively. Accordingly, in the cooling mode, refrigerant flows through indoor heat exchanger 93 in a single-pass arrangement where refrigerant flows through each set of tubes 110 and 112 in parallel. As the refrigerant flows through tubes 110 and 112, the refrigerant is heated by a fluid, such as air, that is drawn across tubes 110 and 112. According to certain embodiments, some, or all, of the refrigerant is evaporated as the refrigerant flows through tubes 110 and 112 and absorbs heat from the environment.

The refrigerant from each section 114 and 116 of manifold 108 exits manifold 108 through separate outlets and is directed to reversing valve 34. For example, the refrigerant from section 114 flows through connection point 126 and into reversing valve 34. Check valve 102 inhibits the flow of refrigerant from connection point 126 into piping segment 96, and accordingly directs the refrigerant exiting section 114 to reversing valve 34. The refrigerant from section 116 flows through connection point 124, through piping segment 96, through check valve 102, and through connection point 126 into reversing valve 34. Accordingly, piping segment 96 allows refrigerant from section 116 of manifold 108 to be recombined with the refrigerant from section 114 of manifold 108.

As shown, the refrigerant from the different sections 114 and 116 of manifold 108 is rejoined upstream of reversing valve 34 at connection point 126. However, in other embodiments, the refrigerant from the different sections 114 and 116 may be rejoined within the reversing valve. From reversing valve 34, the refrigerant flows to compressor 30 as primarily a low pressure and temperature vapor. Within compressor 30, the refrigerant is compressed to primarily a high temperature and high pressure vapor that is ready to enter outdoor heat exchanger 26 and begin the refrigeration cycle again.

FIG. 5 depicts heat pump system 91 operating in the heating mode where outdoor heat exchanger 26 functions as a single-pass evaporator and indoor heat exchanger 93 functions as a two-pass condenser. From compressor 30, the refrigerant flows through reversing valve 34 and connection point 126 to indoor heat exchanger 93. Check valve 102 inhibits the flow of refrigerant from connection point 126 into piping segment 96, and, consequently, piping segment 96 is bypassed in the heating mode.

The refrigerant enters indoor heat exchanger 93 through section 114 of manifold 108. Baffle 118 separates refrigerant entering indoor heat exchanger 93 from refrigerant exiting indoor heat exchanger 93, creating two-passes for refrigerant flowing through the heat exchanger in the heating mode. In particular, baffle 118 directs refrigerant entering manifold 108 though section 114 into tubes 110. The refrigerant then flows through tubes 110 into manifold 106. From manifold 106 refrigerant flows through tubes 112 to section 116 of manifold 108. As the refrigerant flows through tubes 110 and 112, the refrigerant may be condensed and/or subcooled as the refrigerant transfers heat to the environment.

In summary, in the heating mode, the refrigerant flows through indoor heat exchanger 93 in two passes. In the first pass, the refrigerant is cooled as the refrigerant flows through tubes 110 from section 114 of manifold 108 to manifold 106. The refrigerant then flows through tubes 112 from manifold 106 to the other section 116 of manifold 108 in a second pass. Accordingly, in the heating mode, the refrigerant flows through each set of tubes 110 and 112 in series.

The refrigerant exits indoor heat exchanger 93 through section 116 of manifold 108 and flows through connection point 124 to piping segment 98. The refrigerant then flows through piping segment 98, check valve 104, and connection point 122 to expansion devices 28 and 29. According to certain embodiments, the head pressure differential within the system 91 may inhibit the flow of refrigerant from connection point 124 towards connection point 126 and from connection point 122 into piping segment 94.

From connection point 122, the refrigerant flows through expansion devices 29 and 28, connection point 66, check valve 74, outdoor heat exchanger 26, piping segment 72, and check valve 76 to connection point 90, as described above with respect to FIG. 3. At connection point 90, the refrigerant from sections 46 and 48 of manifold 44 is combined and directed through reversing valve 34 to compressor 30, where the refrigeration cycle may begin again.

Figure 6:
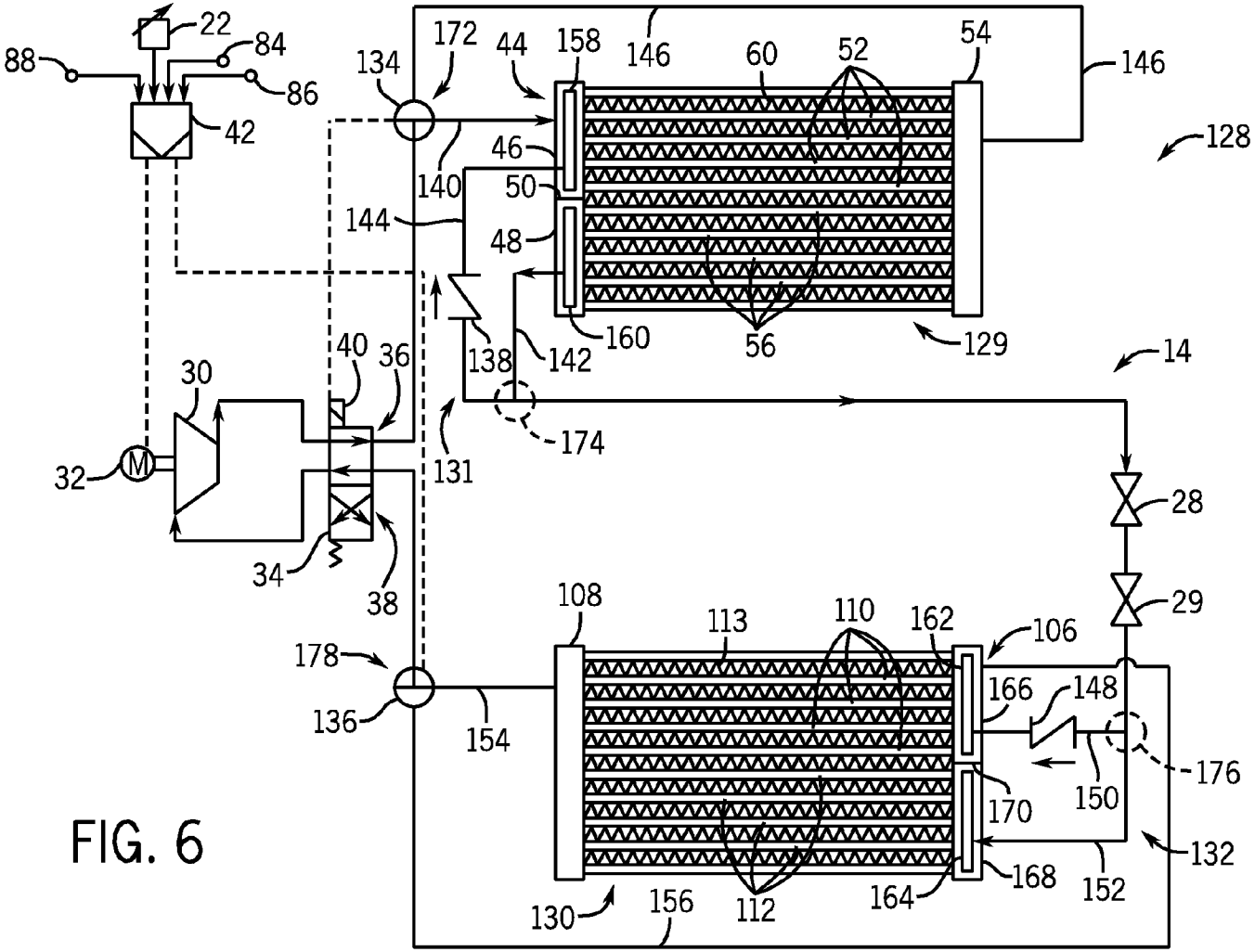
FIG. 6 is a diagrammatical overview showing the cooling mode of another embodiment of a heat pump system with outdoor and indoor heat exchangers switchable between two-pass condensers and single-pass evaporator, in accordance with the present techniques.
Figure 7:
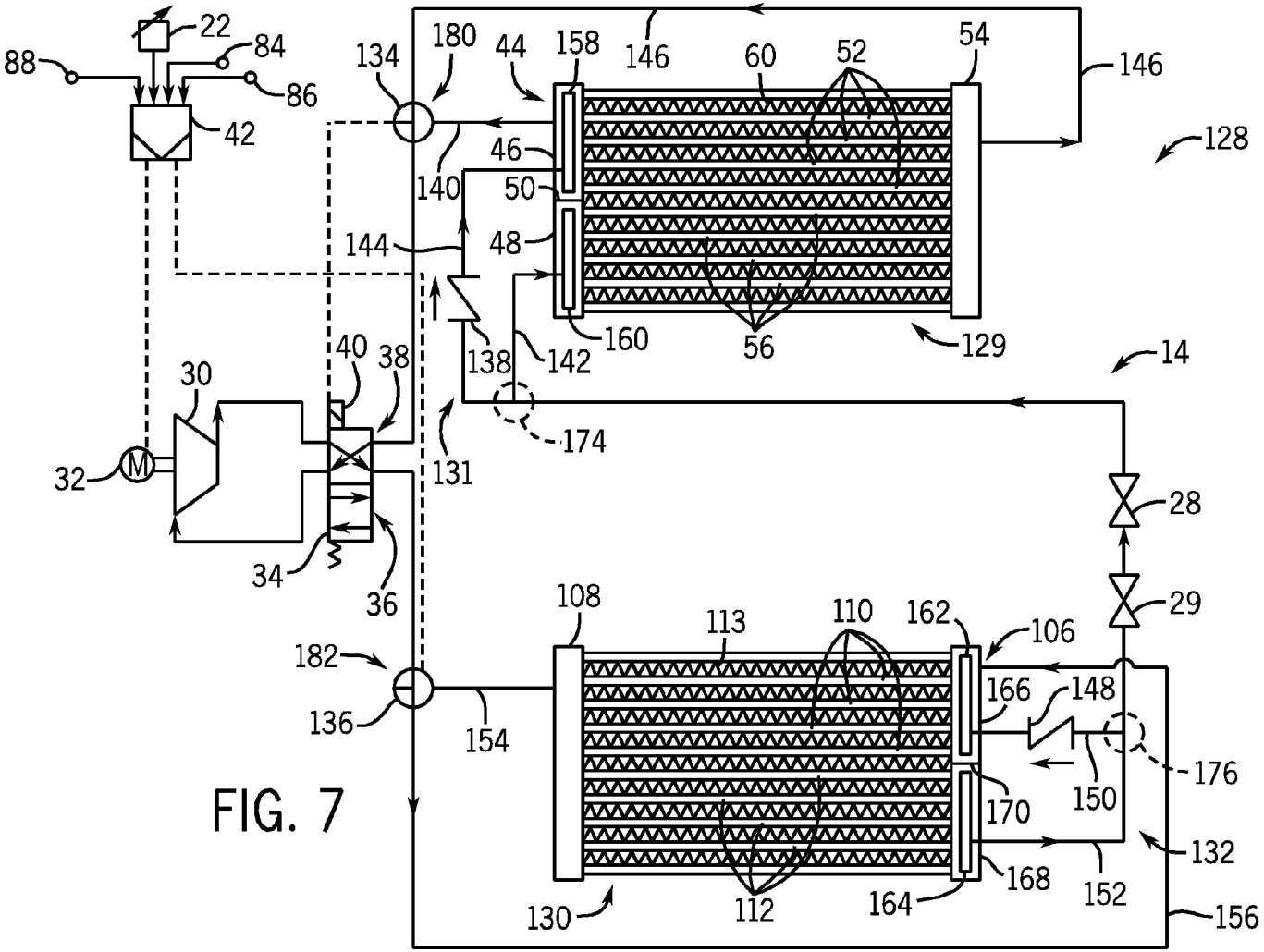
FIG. 7 is a diagrammatical overview showing the heating mode of the heat pump system of FIG. 6, in accordance with the present techniques.

FIGS. 6 and 7 depict another embodiment of a heat pump system 128. Similar to heat pump system 91 (FIGS. 4 and 5), heat pump system 128 includes an outdoor heat exchanger 129 and an indoor heat exchanger 130 that are switchable between a two-pass arrangement and a single-pass arrangement. However, rather than including flow directing systems 67 and 92 (FIGS. 4 and 5) that allow refrigerant to enter the heat exchangers through different inlet manifolds in the heating and cooling modes, heat pump system 128 includes flow directing systems 131 and 132 that allow refrigerant to exit the heat exchangers through different outlet manifolds in the heating and cooling modes.

Flow directing system 131 includes a switching valve 134, a check valve 138, and piping segments 140, 142, 144, and 146 that allow outdoor heat exchanger 129 to be switched between a two-pass condenser where refrigerant enters and exits the heat exchanger through manifold 44 and a single-pass evaporator where refrigerant enters the heat exchanger through manifold 44 and exits the heat exchanger through manifold 54. Flow directing system 132 includes a switching valve 136, a check valve 148, and piping segments 150, 152, 154, and 156 that allow indoor heat exchanger 130 to be switched between a single-pass evaporator where refrigerant enters the heat exchanger through manifold 106 and exits the heat exchanger through manifold 108 and a two-pass condenser where refrigerant enters and exits the heat exchanger through manifold 106.

Check valves 138 and 148 are designed to control the direction of refrigerant flow through closed loop 14. Check valves 138 and 148 may be ball check valves, diaphragm check valves, swing check valves, or other types of check valve suitable for unidirectional flow. Switching valves 134 and 136 can be electrically coupled to controller 42 and actuated by controller 42 when switching heat pump system 128 between the cooling mode and the heating mode. Further, switching valves 134 and 136 can be any suitable type of three-way control valves, such as pneumatic or solenoid valves among others.

Heat exchangers 129 and 130 are generally similar to heat exchangers 26 and 93, discussed above with respect to FIG. 4. However, rather than including a single distributor device, each heat exchanger 129 and 130 includes a pair of distributor devices 158, 160, 162, and 164. In particular, manifold 44 of outdoor heat exchanger 129 includes distributor device 158 disposed in section 46 and distributor device 160 disposed in section 48. Manifold 106 of indoor heat exchanger 130 is divided into sections 166 and 168 by a baffle 170. Distributor device 162 is disposed in section 166 and distributor device 164 is disposed in section 168.

As discussed further below with respect to FIGS. 6 and 7, distributor devices 158, 160, 162, and 164 can be employed to distribute refrigerant along the respective manifold sections 46, 48, 166, and 168 when the heat exchangers 129 and 130 are functioning as single-pass evaporators. According to certain embodiments, distributor devices 158, 160, 162, and 164 may be circular tubes or pipes concentrically disposed inside manifold 44 or 106. Further, distributor devices 158, 160, 162, and 164 may include a series of apertures disposed along the length of the distributor device to meter refrigerant flowing through the interior of the distributor device into the manifold. In other embodiments, the shape, alignment within the manifold, and/or the number and spacing of the apertures may vary. Further, in certain embodiments, one or more of distributor devices 158, 160, 162, and 164 may be omitted and refrigerant may be supplied directly into manifold 106. Moreover, in other embodiments, a different type of distributor device may be used.

FIG. 6 depicts heat pump system 128 operating in the cooling mode with outdoor heat exchanger 129 operating as a two-pass condenser and indoor heat exchanger 130 operating as a single-pass evaporator. Refrigerant is compressed in compressor 30 and flows through reversing valve 34 to switching valve 134. In the cooling mode, switching valve 134 is disposed in the cooling position 172 to direct refrigerant from switching valve 134 through piping segment 140 to manifold 44 of outdoor heat exchanger 129. Accordingly, in the cooling mode, the refrigerant bypasses piping segment 146.

From piping segment 140, the refrigerant flows into distributor device 158 within section 46 of manifold 44. Distributor device 158 distributes the refrigerant along the length of section 46 and into tubes 52. Piping segment 144 is also connected to distributor 158; however, check valve 138 inhibits flow from distributor device 158 into piping segment 138. From distributor device 158, the refrigerant flows through tubes 52 into manifold 54. The refrigerant then flows through tubes 56 to section 48 of manifold 44. Accordingly, in the cooling mode, the refrigerant flows through outdoor heat exchanger 129 in two passes where the refrigerant flows through each set of tubes 52 and 56 in series. As the refrigerant flows through tubes 52 and 56, the refrigerant may be condensed and/or subcooled as the refrigerant transfers heat to the environment.

The refrigerant exits outdoor heat exchanger 129 through section 48 of manifold 44 and flows through a piping segment 142. The refrigerant then flows through a connection point 174, which connects piping segments 142 and 144 to the rest of closed loop 14. In the cooling mode, the pressure differential within the heat pump system 128 inhibits the flow of refrigerant from connection point 174 into piping segment 144, and directs the refrigerant from connection point 174 to expansion devices 28 and 29. Within expansion device 28, the refrigerant expands to become primarily a low pressure and low temperature two-phase refrigerant.

From expansion devices 28 and 29, the refrigerant flows to a connection point 176 where the refrigerant is split into two portions, with one portion entering piping segment 150 and the other portion entering piping segment 152. Piping segment 150 includes check valve 148 that allows unidirectional flow from connection point 176 into distributor 162. The refrigerant flows through check valve 148 and into distributor device 162 within section 166 of manifold 106. The refrigerant from piping segment 152 enters distributor device 164 within section 168 of manifold 106. The refrigerant from each distributor device 162 and 164 is then directed through tubes 110 and 112, respectively. Accordingly, in the cooling mode, refrigerant flows through indoor heat exchanger 130 in a single-pass arrangement where refrigerant flows through each set of tubes 110 and 112 in parallel. As the refrigerant flows through tubes 110 and 112, the refrigerant absorbs heat from the environment, causing some, or all, of the refrigerant to evaporate, before entering manifold 108.

The refrigerant exits manifold 108 and flows through piping segment 154 to a switching valve 136. In the cooling mode, switching valve 136 is disposed in the cooling position 178 to direct refrigerant from switching valve 136 to reversing valve 34. Accordingly, in the cooling mode, the refrigerant bypasses piping segment 156. From reversing valve 34, the refrigerant flows to compressor 30 as primarily a low pressure and temperature vapor. Within compressor 30, the refrigerant is compressed to primarily a high temperature and high pressure vapor that is ready to enter outdoor heat exchanger 129 and begin the refrigeration cycle again.

FIG. 7 depicts heat pump system 128 operating in the heating mode with outdoor heat exchanger 129 operating as a single-pass evaporator and indoor heat exchanger 130 operating as a two-pass condenser. As can be seen by comparing FIGS. 6 and 7, in the heating mode, reversing valve 34 is in the heating position 38 and the flow of refrigerant through closed loop 14 is reversed. Further, the switching valves 134 and 136 are switched to heating positions 180 and 182, respectively. The heating positions 180 and 182 enable refrigerant to flow through indoor heat exchanger 130 in a two-pass arrangement and through outdoor heat exchanger 129 in a single-pass arrangement.

As in the cooling mode, compressor 30 compresses vapor refrigerant to a primarily high temperature and high pressure vapor. From compressor 30, the refrigerant flows through reversing valve 34 to switching valve 136. In the heating mode, switching valve 136 is disposed in the heating position 182 to direct refrigerant from switching valve 136 through piping segment 156 to manifold 106 of indoor heat exchanger 130. Accordingly, in the heating mode, the refrigerant bypasses piping segment 154.

From piping segment 156, the refrigerant flows into distributor device 162 within section 166 of manifold 106. Distributor device 162 distributes the refrigerant along the length of section 166 and into tubes 110. Piping segment 150 is also connected to distributor device 162; however, check valve 148 inhibits flow from distributor device 162 into piping segment 150. From distributor device 162, the refrigerant flows through tubes 110 into manifold 108. The refrigerant then flows through tubes 112 to section 168 of manifold 106. Accordingly, in the heating mode, the refrigerant flows through indoor heat exchanger 130 in two passes where the refrigerant flows through each set of tubes 110 and 112 in series. As the refrigerant flows through tubes 110 and 112, the refrigerant may be condensed and/or subcooled as the refrigerant transfers heat to the environment.

The refrigerant exits indoor heat exchanger 130 through section 168 of manifold 106 and flows through a piping segment 152. The refrigerant then flows through connection point 176 to expansion devices 28 and 29. In the heating mode, the pressure differential within the heat pump system 128 inhibits the flow of refrigerant from connection point 176 into piping segment 150, and directs the refrigerant from connection point 176 to expansion devices 29 and 28. Within expansion device 29, the refrigerant expands to become primarily a low pressure and low temperature two-phase refrigerant.

From expansion devices 29 and 28, the refrigerant flows to a connection point 174 where the refrigerant is split into two portions, with one portion entering piping segment 142 and the other portion entering piping segment 144. Piping segment 144 includes check valve 138 that allows unidirectional flow from connection point 174 into distributor device 158. The refrigerant flows through check valve 138 and into distributor device 158 within section 46 of manifold 44. The refrigerant from piping segment 142 enters distributor device 160 within section 48 of manifold 44. The refrigerant from each distributor device 158 and 160 is then directed through tubes 52 and 56, respectively. Accordingly, in the heating mode, refrigerant flows through outdoor heat exchanger 129 in a single-pass arrangement where refrigerant flows through each set of tubes 52 and 56 in parallel. As the refrigerant flows through tubes 52 and 56, the refrigerant absorbs heat from the environment, causing some, or all, of the refrigerant to evaporate, before entering manifold 54.

The refrigerant exits manifold 54 and flows through piping segment 146 to switching valve 134. In the heating mode, switching valve 134 is disposed in the heating position 180 to direct refrigerant from switching valve 134 to reversing valve 34. Accordingly, in the heating mode, the refrigerant bypasses piping segment 140. From reversing valve 34, the refrigerant flows to compressor 30 as primarily a low pressure and temperature vapor. Within compressor 30, the refrigerant is compressed to primarily a high temperature and high pressure vapor that is ready to enter indoor heat exchanger 130 and begin the refrigeration cycle again.

While only certain features and embodiments of the invention have been illustrated and described, many modifications and changes may occur to those skilled in the art (e.g., variations in sizes, dimensions, structures, shapes and proportions of the various elements, values of parameters (e.g., temperatures, pressures, etc.), mounting arrangements, use of materials, orientations, etc.) without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the invention. Furthermore, in an effort to provide a concise description of the exemplary embodiments, all features of an actual implementation may not have been described (i.e., those unrelated to the presently contemplated best mode of carrying out the invention, or those unrelated to enabling the claimed invention). It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The invention claimed is:

1. A heat pump system, comprising:

a reversing valve configured to circulate a refrigerant through a closed loop in a first direction when the heat pump system is operating in a heating mode and in a second direction opposite of the first direction when the heat pump system is operating in a cooling mode; a compressor configured to compress the refrigerant;

an indoor heat exchanger operable as a condenser in the heating mode and as an evaporator in the cooling mode;

an outdoor heat exchanger operable as a two-pass condenser in the cooling mode and as a single-pass evaporator in the heating mode, the outdoor heat exchanger comprising:

a first manifold;

a second manifold subdivided by a baffle into a first section and a second section; and a plurality of tubes in fluid communication with the first manifold and the second manifold;

at least one expansion device disposed in the closed loop between the indoor heat exchanger and the outdoor heat exchanger, and configured to reduce pressure of the refrigerant; and a flow directing system configured to direct the refrigerant from the reversing valve into the first section of the second manifold and out of the second section of the second manifold to the expansion device in the cooling mode and to direct the refrigerant from the expansion device into the first section and the second section of the second manifold and subsequently out of the first manifold to the reversing valve in the heating mode, wherein the flow directing system comprises at least a first valve disposed in a first piping segment and a second piping segment to block flow of the refrigerant from the first manifold to the reversing valve in the cooling mode and to block flow of the refrigerant from the first section of the second manifold to the reversing valve in the heating mode, and a second valve disposed in a third piping segment to block the refrigerant from bypassing the second section of the second manifold in the cooling mode.

2. The heat pump system of claim 1, wherein the first piping segment is configured to direct the refrigerant exiting the first manifold to the reversing valve in the heating mode; the second piping segment is configured to direct the refrigerant exiting the reversing valve into the first section of the second manifold in the cooling mode; and the third piping segment is configured to direct the refrigerant exiting the expansion device into the first section of the second manifold in the heating mode.

3. The heat pump system of claim 1, wherein the first and second valves are external to the first manifold and external to the second manifold.

4. The heat pump system of claim 1, wherein the plurality of tubes comprise a first plurality of tubes in fluid communication with the first manifold and the first section of the second manifold and a second plurality of tubes in fluid communication with the first manifold and the second section of the second manifold, wherein the outdoor heat exchanger is configured to direct the refrigerant through the first plurality of tubes and the second plurality of tubes in series in the cooling mode, and wherein the outdoor heat exchanger is configured to direct the refrigerant through the first plurality of tubes and the second plurality of tubes in parallel in the heating mode.

5. The heat pump system of claim 1, wherein the second manifold is configured to receive the refrigerant entering the outdoor heat exchanger in the heating mode and to receive the refrigerant entering the outdoor heat exchanger in the cooling mode.

6. The heat pump system of claim 1, wherein the outdoor heat exchanger is configured to receive the refrigerant from both the first section of the second manifold and the second section of the second manifold in the heating mode.

7. The heat pump system of claim 1, wherein at least one of the outdoor heat exchanger or the indoor heat exchanger comprises an air-cooled heat exchanger.

8. The heat pump system of claim 1, wherein the tubes comprise multichannel tubes.

9. The heat pump system of claim 1, comprising a distributor tube disposed in the first manifold to distribute the refrigerant within the first manifold.

10. A heat pump system, comprising:

a reversing valve configured to circulate a refrigerant through a closed loop in a first direction when the heat pump system is operating in a heating mode and in a second direction opposite of the first direction when the heat pump system is operating in a cooling mode;

a compressor configured to compress the refrigerant;

an indoor heat exchanger operable as a condenser in the heating mode and as an evaporator in the cooling mode;

an outdoor heat exchanger operable as a two-pass condenser in the cooling mode and as a single-pass evaporator in the heating mode, the outdoor heat exchanger comprising:

a first manifold;

a second manifold subdivided by a baffle into a first section and a second section; and a plurality of tubes in fluid communication with the first manifold and the second manifold;

a pair of unidirectional expansion devices disposed in the closed loop between the indoor heat exchanger and the outdoor heat exchanger, and configured to reduce pressure of the refrigerant; and a flow directing system comprising one or more valves and piping segments of the closed loop, the flow directing system configured to direct the refrigerant from the reversing valve into the first section of the second manifold and out of the second section of the second manifold to the expansion device in the cooling mode and to direct the refrigerant from the expansion device into the first section and the second section of the second manifold and subsequently out of the first manifold to the reversing valve in the heating mode.

11. The heat pump system of claim 10, wherein the flow directing system comprises one or more switching valves.

12. The heat pump system of claim 10, wherein the indoor heat exchanger is operable as another two-pass condenser in the heating mode and as another single-pass evaporator in the cooling mode.

13. The heat pump system of claim 10, comprising a first distributor device disposed in the first section of the second manifold and a second distributor device disposed in the second section of the second manifold.

14. A heat pump system, comprising:

a reversing valve configured to circulate a refrigerant through a closed loop in a first direction when the heat pump system is operating in a heating mode and in a second direction opposite of the first direction when the heat pump system is operating in a cooling mode;

an outdoor heat exchanger, comprising:

a first manifold;

a second manifold subdivided by a baffle into a first section and a second section; and a plurality of tubes in fluid communication with the first manifold and the second manifold;

an indoor heat exchanger, comprising:

a third manifold;

a fourth manifold subdivided by an indoor heat exchanger baffle into a first section and a second section; and a plurality of tubes in fluid communication with the third manifold and the fourth manifold; and a flow directing system comprising one or more valves and piping segments of the closed loop, the flow directing system configured to, in the cooling mode, direct the refrigerant from the reversing valve into the first section of the second manifold of the outdoor heat exchanger and out of the second section of the second manifold of the outdoor heat exchanger to an expansion device and, in the heating mode, to direct the refrigerant from the expansion device into the first and second sections of the second manifold of the outdoor heat exchanger and subsequently out of the first manifold of the outdoor heat exchanger to the reversing valve.

15. The heat pump system of claim 14, comprising an additional flow directing system comprising one or more valves and piping segments of the closed loop, the additional flow directing system configured to, in the cooling mode, direct the refrigerant to enter the indoor heat exchanger through the first and second sections of the fourth manifold and to exit the indoor heat exchanger through the third manifold and, in the heating mode, to direct the refrigerant to enter the indoor heat exchanger through the first section of the fourth manifold and to exit the indoor heat exchanger through the second section of the fourth manifold.

16. The heat pump system of claim 1, wherein the third piping segment of the flow directing system is coupled to the first section of the second manifold at a first end of the third piping segment and to the expansion device at a second end of the third piping segment.

17. The heat pump system of claim 1, wherein the first piping segment of the flow directing system is coupled to the first manifold at a first end of the first piping segment and to the reversing valve at a second end of the first piping segment.

18. The heat pump system of claim 1, wherein the second piping segment of the flow directing system is coupled to the first section of the second manifold at a first end of the second piping segment and to the first valve at a second end of the second piping segment.

* * * * *